US008148639B2

(12) United States Patent
Auphand et al.

(10) Patent No.: US 8,148,639 B2
(45) Date of Patent: Apr. 3, 2012

(54) ELECTRICAL CABLE PROVIDED WITH EXTERNAL MARKING AND METHOD OF CRIMPING THE BARREL OF A CONTACT ONTO AN ELECTRICAL CABLE PROVIDED WITH EXTERNAL MARKING

(75) Inventors: Jerome Auphand, Toulouse (FR); Regis Ruffel, Carcassonne (FR)

(73) Assignee: Airbus France, Toulouse (FR)

( * ) Notice: Subject to any disclaimer, the term of this patent is extended or adjusted under 35 U.S.C. 154(b) by 470 days.

(21) Appl. No.: 11/916,984

(22) PCT Filed: Jun. 1, 2006

(86) PCT No.: PCT/FR2006/001293

§ 371 (c)(1),
(2), (4) Date: Jul. 31, 2008

(87) PCT Pub. No.: WO2006/134251

PCT Pub. Date: Dec. 21, 2006

(65) Prior Publication Data

US 2009/0211780 A1 Aug. 27, 2009

(30) Foreign Application Priority Data

Jun. 14, 2005 (FR) ..... 05 51593

(51) Int. Cl.
*H01B 7/00* (2006.01)

(52) U.S. Cl. ..... 174/110 R; 174/112

(58) Field of Classification Search ..... 174/110 R, 174/111, 112, 113 R, 69, 71 R, 72 R, 72 A
See application file for complete search history.

(56) References Cited

U.S. PATENT DOCUMENTS

| | | | | |
|---|---|---|---|---|
| 1,607,432 | A * | 11/1926 | Bryce | 174/112 |
| 3,197,554 | A * | 7/1965 | Baker | 174/112 |
| 5,142,105 | A * | 8/1992 | Kihlken et al. | 174/112 |
| 5,645,899 | A * | 7/1997 | Unterberger | 427/558 |
| 7,211,733 | B2 * | 5/2007 | Kurimoto et al. | 174/110 R |
| 7,482,539 | B2 * | 1/2009 | Katsumata et al. | 174/110 R |

FOREIGN PATENT DOCUMENTS

| | | | |
|---|---|---|---|
| JP | 2003-168329 | * | 6/2003 |
| JP | WO2004-100181 | * | 11/2004 |
| WO | 2004/100181 A | | 11/2004 |

OTHER PUBLICATIONS

Patent Abstracts of Japan, vol. 016, No. 037 (E-1160), Jan. 29, 1992 & JP 03 245413 A, Yamaha Corp., Nov. 1, 1991.

* cited by examiner

*Primary Examiner* — William Mayo, III
(74) *Attorney, Agent, or Firm* — Perman & Green, LLP

(57) ABSTRACT

An electrical cable (1) provided with a sheath (2) having external marking. The marking is formed from a block (3) of two patterns (4, 5), the two patterns being consecutive along a length of the cable, said block being repeated at least twice along the length of the cable starting from the free end (12) of the cable. The disclosed embodiments also relates to a method of crimping a contact (7) onto such a cable, the external marking of the cable making it possible to know the position of the cable in the barrel and thus guarantee that the crimping that takes place will be of good quality.

17 Claims, 2 Drawing Sheets

ELECTRICAL CABLE PROVIDED WITH EXTERNAL MARKING AND METHOD OF CRIMPING THE BARREL OF A CONTACT ONTO AN ELECTRICAL CABLE PROVIDED WITH EXTERNAL MARKING

CROSS-REFERENCE TO RELATED APPLICATIONS

This application is the National Stage of International Application No. PCT/FR2006/001293, filed on Jun. 1, 2006, which designated the United States of America, and which international application was published under PCT Article 21(2) as WO Publication No. WO 2006/134251 A1 and which claims priority from French Application No. 0551593, filed Jun. 14, 2005.

BACKGROUND

1. Field

The disclosed embodiments relate to an electrical cable provided with external marking that allows the position of the cable in a barrel that has to be crimped onto said cable to be checked. The disclosed embodiments also relate to a method of crimping a barrel onto such a cable. More precisely, the disclosed embodiments relate to marking visible to the naked eye, provided on the sheath of the cable, said marking being repeated so as to make it possible, by a simple visual check, to ensure that the cable is correctly positioned in the barrel before the barrel is crimped onto the cable and thus guarantee electrical continuity between the cable and the barrel.

One aspect of the disclosed embodiments is to guarantee good crimping of the barrel of a contact onto an electrical cable so as to ensure electrical continuity between the cable and the electronic device connected to the cable via the contact.

2. Brief Description of Related Developments

At the present time, when connecting the core of a cable to the barrel of a contact, it is known to use a barrel provided with a peephole. The peephole, which passes through one wall of the barrel, emerges in the cavity of the barrel. The peephole makes it possible in particular to verify the position of the cable in the barrel before the barrel is crimped onto said cable. Thus, it is possible to confirm the position of the cable, and therefore the electrical continuity between the cable and the contact, before the crimping. To do this, it suffices to verify, by looking through the peephole, that the core of the cable is correctly positioned inside the barrel.

However, it is sometimes necessary to use a contact in which the barrel does not have a peephole or in which the peephole is obstructed. Such a contact is especially appropriate when a cable having an aluminum conducting core is used. This is because, in such a case, it is preferable to prevent this conducting core from being exposed to the air so as to reduce the risk of it oxidizing, which could result in poorer electrical continuity between said conducting core and said contact. The use of a contact without a peephole in its barrel or a contact with its peephole obstructed helps to prevent air from passing into the barrel of this contact, when the latter is crimped, thus contributing to reducing the risk of the conducting core of the cable oxidizing. However, it is then no longer possible to verify the position of the cable in the barrel of the contact before crimping, since the barrel has no peephole or the peephole is obstructed. As a result, there is a greater risk of defective crimped joints.

Poor crimping of the barrel onto the cable may in particular incur the risk of producing an intermittently defective contact, or the risk of heating the cable, or the risk of the connection between the cable and the contact undergoing accelerated aging, or the risk of a loss of function of the electronic system provided with this defective connection.

SUMMARY

Another aspect of the disclosed embodiments is to provide a means of verifying the position of the cable in the barrel of a contact before crimping so as to guarantee that the cable is properly positioned in the barrel and that there is correct electrical continuity along the cable and the contact. Another aspect of the disclosed embodiments is to provide a method for reliable electrical crimping of a barrel onto a cable, irrespective of the nature of the conducting core of the cable.

To achieve this result, the disclosed embodiments propose to provide visual checking means not on the barrel intended to be crimped onto the cable, but on the cable itself. The cable according to the disclosed embodiments is provided along its length with repeated external marking. The external marking consists of a set of two consecutive patterns along the length of the cable, these being repeated at least twice along the length of the cable. The marking allows the position of the cable in the barrel of the contact to be known before said barrel is crimped onto the cable. According to the disclosed embodiments, this visual checking means is used for cutting the cable precisely, so as to form a connection end. The connection end is then stripped in order to expose the core of the cable, which will be introduced into the barrel of the contact. Once the cable is introduced into the contact barrel, the visual checking means, formed by the marking, is used to ensure that the cable is perfectly positioned in the barrel. Next, the barrel is crimped onto the cable, electrical crimped connection being guaranteed. The visual checking means according to the disclosed embodiments is therefore useful at the moment of cutting the cable, at the moment of inserting the cable into the barrel of the contact and at the moment of crimping the barrel onto the cable. By respecting these steps, it is possible to obtain correct crimping of the barrel onto the cable in a reliable manner. The pitch between two consecutive sets of two patterns, and also the distance separating two patterns of one and the same set, depends in particular on the cross section of the cable. For a given cable cross section, to which one dimension of the contact barrel corresponds, the specific external marking is made with a fixed pitch and a fixed distance, whereby guaranteeing a reliable visual check, and therefore reliable electrical crimping of the barrel onto the contact, without there being a need for any other check, such as a visual check through a peephole on the barrel. Such marking according to the disclosed embodiments may be carried out on current cables. This is because the marking according to the disclosed embodiments may be affixed to the sheath of any cable and may even be combined with other marking having another function, such as to allow the cable to be identified. This marking may be easily carried out by a laser.

One subject of the disclosed embodiments is therefore an electrical cable provided with a sheath having external marking, formed from a block of two consecutive patterns along a length of the cable, characterized in that said block of patterns is repeated at least twice along the length of the cable starting from a free end of the cable, the marking depending on the diameter of the cable.

According to various exemplary embodiments, it is possible to provide the cable with all or some of the following additional features:

the distance between two patterns of one and the same block and/or the distance between two blocks of adjacent patterns are/is dependant on the diameter of the cable;

the marking is repeated at least at the two ends of the cable;

the marking is repeated over the entire length of the cable;

the distance between two blocks of adjacent patterns is constant for a given cable cross section;

the two consecutive patterns of a block of patterns are separated from each other by an unmarked region;

the patterns are squares or rectangles; and the core of the cable is made of aluminum.

Another subject of the disclosed embodiments is a method of crimping the barrel of a contact onto a cable, characterized in that it includes the step consisting in:

marking the sheath of the cable, before crimping, with repeated external marking along the length of the cable, so as to be able to check a position of the cable in the barrel.

For example, the external marking consists of a block of two patterns, the two patterns being consecutive along a length of the cable, said block of patterns being repeated at least twice along the length of the cable starting from the free end of the cable. In a preferred exemplary embodiment, the distance between two adjacent patterns belonging to two different blocks of patterns is substantially equal to the depth of the barrel of the contact that has to be crimped onto said cable.

The method according to the disclosed embodiments may include all or some of the following additional steps, consisting in:

cutting the cable between two patterns of one and the same block, then introducing the cable into the barrel and verifying that the open end of the barrel of the contact is located, relative to the marking, within an acceptance region indicating a correct crimping position and crimping the barrel of the contact onto the cable. Until the cable has been correctly inserted into the barrel, the cable continues to be inserted thereinto. Thus, after the verification step, the step of introducing the cable into the barrel can resume. It is only once the open end of the contact barrel is correctly positioned in the acceptance region that the crimping operation can proceed.

In one particular example of implementing the method according to the disclosed embodiments, the correct crimping position is obtained when the open end of the barrel of the contact partly surrounds one of the two patterns of the block of patterns that is partly housed in the barrel.

In one embodiment, the cable is stripped before being introduced into the barrel of the contact.

Depending on the requirements, it is possible to produce an electrical crimped connection by crimping the barrel of the contact onto the core of the cable and/or a sealing connection by crimping the barrel of the contact onto the sheath of the cable.

Preferably, the external marking of the sheath is carried out by a laser so as to achieve great precision, especially as regards the distances between two patterns and the pitch between two blocks of patterns.

It is also possible to carry out manual marking, for example by means of a marking template.

BRIEF DESCRIPTION OF THE DRAWINGS

The disclosed embodiments will be more clearly understood on reading the following description and on examining the figures that accompany it. These are shown by way of indication but imply no limitation of the disclosed embodiments. The figures represent.

DETAILED DESCRIPTION OF THE EXEMPLARY EMBODIMENT(S)

Figures 1A, 1B, 1C, 1D:
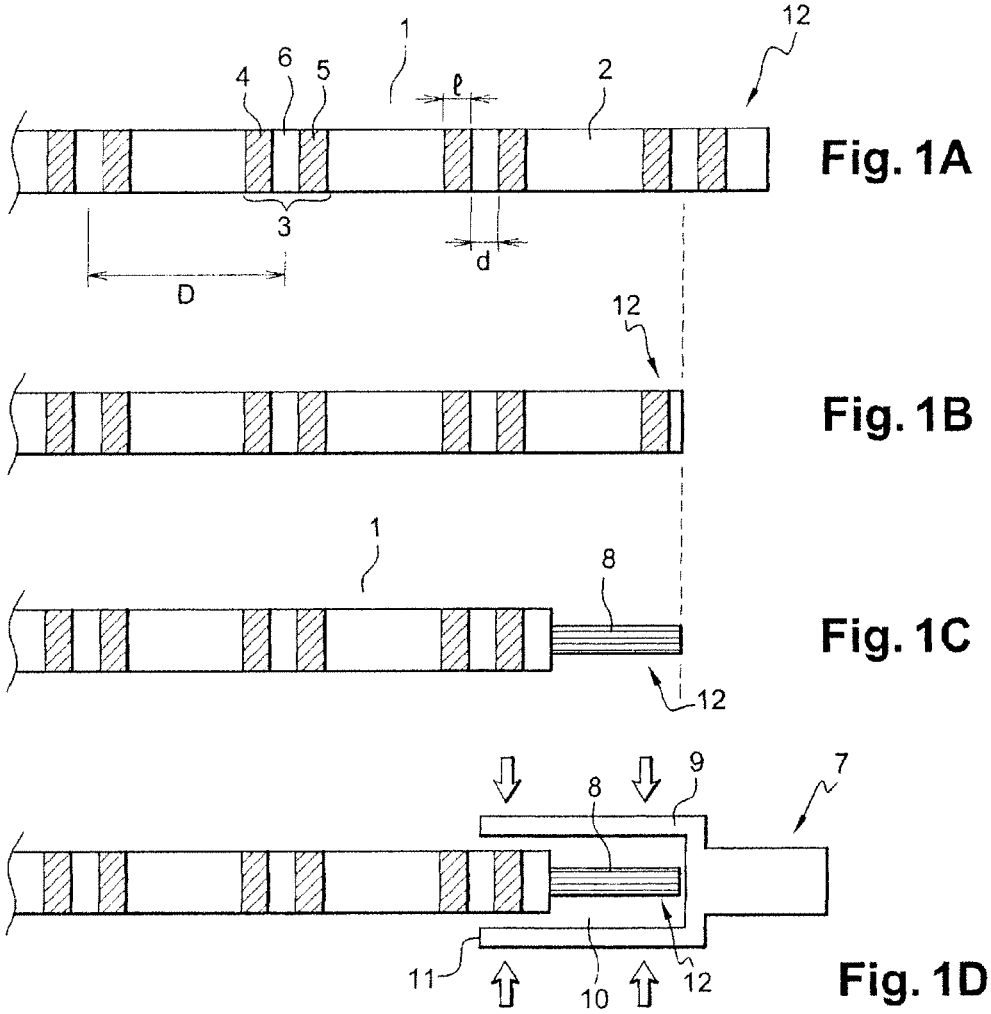
FIGS. 1A to 1D: an example of implementation of the crimping method according to the disclosed embodiments.

FIG. 1A shows an example of a cable provided with external marking according to the disclosed embodiments.

The cable 1 has an insulating external sheath 2. The marking consists of a block 3 of two consecutive patterns 4, 5 separated from each other by an unmarked region 6. The two consecutive patterns 4, 5 of the block 3 of patterns are consecutive along the length of the cable 1. The term "length of the cable 1" is understood to mean the longest dimension of the cable 1, parallel to the longitudinal axis of said cable 1. The block 3 of patterns is repeated several times along the cable 1.

In the example shown in FIG. 1A, the patterns 4, 5 are rings surrounding the cable 1 in its diameter. The patterns 4, 5 are therefore continuous over the entire cross section of the cable 1. In other exemplary embodiments, it is possible to produce external marking with different patterns.

Figure 4:
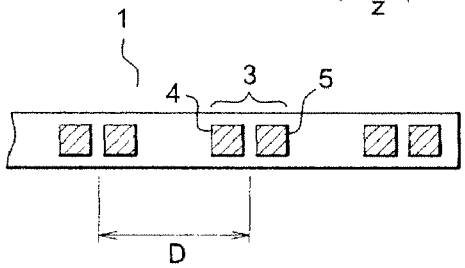
FIG. 4: a schematic representation of a cable according to an exemplary embodiment.

In FIG. 4, the patterns 4, 5 of the blocks 3 of patterns are squares. It is possible to produce only a single square in one section of the cable 1 in question. Of course, it is also possible to produce several squares in said section so as to surround the cross section of the cable 1 in question with patterns 4, 5. The external marking according to the disclosed embodiments is therefore visible whatever the position of the cable 1 relative to a user.

Figure 5:
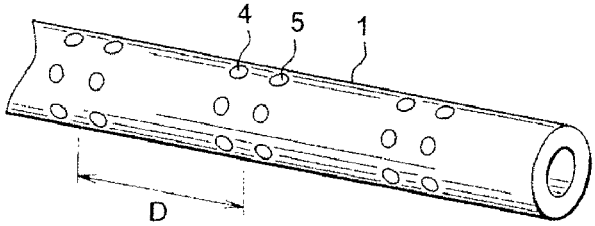
FIG. 5: a schematic representation of a cable according to another exemplary embodiment.

FIG. 5 shows another exemplary embodiment of a cable 1 according to the disclosed embodiments, in which the patterns 4, 5 of the blocks 3 of patterns are round. The round features 4, 5 are repeated several times over the cross section of the cable so as to form discontinuous rings around the cable 1. Thus, whatever the position of the cable 1, or the location in which it is placed, the external marking is visible. For example, if the crimping is carried out in a crimping device, a person may check the position of the cable 1 in the barrel of a contact without having to contort his body or shift the cable 1 in the crimping device in order to see the marking.

The distance D, or pitch, separating two blocks 3 of patterns is constant along the cable 1. The pitch D may in particular depend on the diameter of the cable 1 and/or on the depth of the barrel of the contact into which the cable is intended to be introduced.

The distance d separating two consecutive patterns 4 and 5 of one and the same block 3 of patterns, which distance defines the unmarked zone 6, may also vary according to the cross section of the cable 1.

Another parameter that may be taken into account for producing the appropriate external marking on the cable 1 is the width l of the features 4, 5. The term "width l" is understood to mean the size of the pattern 4, 5 parallel to the axis of the cable 1. Thus, in the example shown in FIG. 5, in which the patterns are circles, the width l corresponds to the diameter of the circles. In the example shown in FIG. 4, in which the patterns 4, 5 are squares, the width l corresponds to the length of one side of a square.

For a cable of size 10, corresponding to a cross section of 5 $mm^2$, the pitch D separating two adjacent blocks 3 is 19 mm (±0.1 mm), the distance d separating two patterns 4, 5 of one and the same block is 2 mm (±0.1 mm) and the width l of the patterns 4, 5 is 0.5 mm (±0.1 mm).

Thus, it is possible to adapt the marking specifically to the diameter of the cable 1, or the cable cross section, and consequently to increase the reliability of the visual checking means according to the disclosed embodiments.

According to the crimping method of the disclosed embodiments, the external marking of the cable is used during various steps.

Firstly, before the cable 1 is introduced into the barrel of a contact, said cable 1 is cut in the unmarked region 6, that is to say between two consecutive patterns 4, 5 of one and the same block 3 of patterns (FIG. 1B).

Said cable 1 is then stripped over a given distance so as to expose the core 8 of the cable 1 over a given length, or crimping length (FIG. 1C). It is this part of the cable 1, formed by the core 8 of the cable 1, that the barrel 9 of a contact 7 must crimp.

A free end 12 of the cable 1 is then introduced into the cavity 10 of the barrel 9 (FIG. 1D). The stripped part of the cable 1 forms the free end 12 of said cable 1. The term "free end 12" is understood in general to mean that end of the cable 1 intended to be introduced into the contact 7.

Once the free end of the cable 1 has been introduced into the cavity 10 of the barrel 9, it is verified that the cable 1 is properly positioned in the barrel 9. To do this, the position of an open end 11 of the barrel 9 relative to the external marking on the cable 1 is verified. The expression "open end 11 of the barrel 9" is understood to mean that end of the barrel 9 which emerges toward the outside and via which the free end 12 of the cable 1 is introduced.

Once it has been verified that the position of the open end 11 of the barrel 9 around the cable 1 corresponds to the expected position, the electrical crimping of the barrel 9 onto the core 8 of the cable 1 is carried out. It is also possible to carry out sealing crimping of the barrel 9 onto the sheath 2 of the cable 1. Thanks to the sealing crimping, the sealing of the connection between the cable 1 and the contact 7 is enhanced and thus the risk of oxidation, especially when the core 8 of the cable 1 is made of aluminum, is reduced.

Figure 2A:
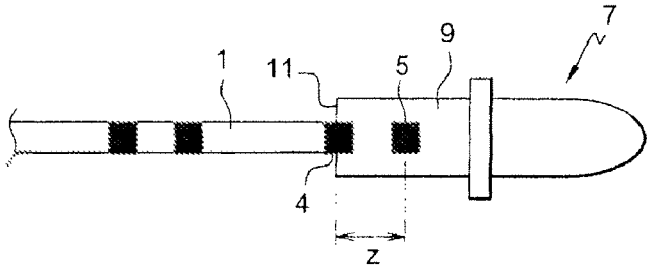
FIGS. 2A and 2B: two examples of the cable being properly positioned in the barrel of a contact before crimping.
Figure 2B:
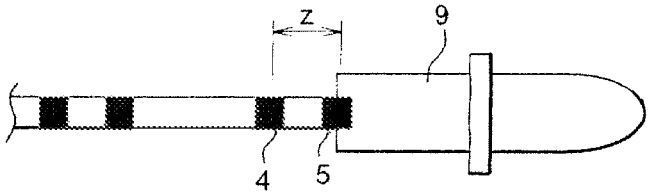

FIGS. 2A and 2B show two examples of the cable 1 properly positioned in the barrel 9 of the contact 7. The block 3 of patterns taken into consideration for visually checking the position of the cable 1 in the barrel 9 is the block 3 immediately visible at the point where the cable 1 leaves the barrel 9.

In FIG. 2A, the open end 11 of the barrel 9 partly surrounds the first pattern 4 of the block 3 of patterns which block is partly housed within the barrel 9. The second pattern 5 of said block 3 is entirely housed within said barrel 9.

In the second example, shown in FIG. 2B, the first pattern 4 of the block 3 is entirely outside said barrel 9, while the second pattern 5 of said block 3 is partially housed within the barrel 9.

FIGS. 2A and 2B show, respectively, the limits of the acceptance interval z in which the user is ensured that the cable 1 is correctly positioned in the barrel. The acceptance interval z here is between the two patterns 4, 5 of one and the same block 3, said block 3 in question being partially housed within the barrel 9. Thus, to ensure that the cable 1 is properly positioned in the barrel 9 before crimping, the block 3 in question for the visual check must be at least partly outside said barrel 9. More precisely, it is necessary for the end 11 of the barrel 9 to surround the cable 1 in the acceptance interval z.

Figure 3A:
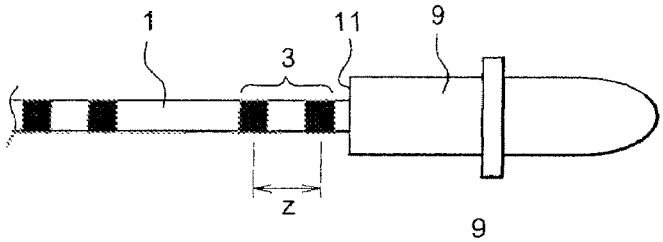
FIGS. 3A and 3B: two examples of a cable improperly positioned in the barrel of a contact.
Figure 3B:
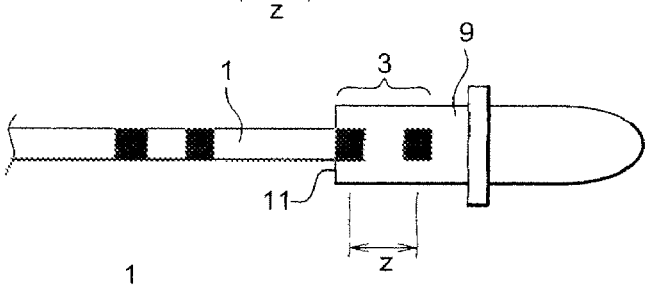

FIGS. 3A and 3B show two cases in which the cable 1 is incorrectly positioned in the barrel 9. Here again, the block 3 of patterns taken into consideration for the visual check of the position of the cable 1 in the barrel 9 is the block 3 immediately visible at the point where the cable 1 leaves the barrel 9.

In the example shown in FIG. 3A, the two patterns 4, 5 of the block 3 are entirely outside the barrel 9, so that the open end 11 of the barrel 9 does not surround the cable 1 in the acceptance interval z, but in a region located upstream of the acceptance interval z. Thus, the core of the cable 1 is not correctly located in the barrel 9 so as to guarantee that, when the barrel 9 is crimped onto the cable 1, there is good contact between the barrel 9 and the core of the cable 1.

In the example shown in FIG. 3B, the block 3 of patterns is entirely housed within the barrel 9, so that the open end 11 of the barrel 9 does not surround the cable 1 in the acceptance interval z but in a region downstream of the acceptance interval z. Thus, the core of the cable 1 is introduced too deeply into the barrel 9 for the crimping of the barrel 9 onto the cable 1 to occur at the core, and said crimping will more certainly take place on the sheath. In the two cases shown in FIGS. 3A and 3B, the crimping will not correspond to the expected crimping, and the user may be made aware of this by a simple glance even before crimping the barrel 9 onto the cable 1.

To guarantee proper crimping, it is sufficient to verify that the open end of the barrel 9 is located within the crimping acceptance interval z, formed between the two consecutive patterns 4, 5 of the block 3 that is partially housed within the barrel 9.

In general, it is sufficient for the cable 1 to be provided with a set of two blocks 3 of patterns, said blocks 3 of patterns being considered from the free end of the cable 1. This is because, in the method according to the disclosed embodiments, the user has need only for two blocks 3 of patterns. The first block 3 of patterns, or block 3 located at the free end 12 of the cable 1, serves as a reference mark for cutting the cable 1 and for forming a new free end 12. The second block 3 of patterns forms the visual means for knowing the position of the cable 1 in the barrel 9.

Of course, it is possible to repeat the block 3 of patterns 4, 5 more than twice along the length of the cable 1, and especially over the entire length of the cable 1. Such a repetition of the marking all along the cable 1 makes it possible to cut said cable 1 at any unmarked region 6 of a block 3 of patterns, and thus to form several secondary cables from a single cable 1, each being able to serve for a connection with a contact 7.

The marking according to the disclosed embodiments may be carried out by means of a laser, which makes it possible to produce said marking with the required precision. In other exemplary embodiments, it is possible to produce external marking by applying colors to the sheath 2 or heat-induced marking, by local application of heat to said sheath 2.

The marking according to the disclosed embodiments may also be produced manually, using for example a marking template so as to facilitate the drawing of the patterns 4, 5. Manual marking may be done by means of a pencil, an ink jet or a paint jet, etc.

What is claimed is:

1. An electrical cable to be crimped in a barrel of a contact, the said cable being provided with a sheath having external marking, formed from a block of two consecutive patterns along a length of the cable, wherein said block of patterns is repeated at least twice along the length of the cable starting from a free end of the cable, the marking depending on the diameter of the cable, and a first block of patterns marks the cable for cutting to form a free end;

the sheath of the cable is allowed to be cut between the two consecutive patterns in order to strip the free end of the cable for exposing a core of the cable to be introduced and crimped into the barrel; and a second block of patterns indicates a position of the free end in the barrel.

2. The cable according to claim 1, wherein the distance (d) between two patterns of one and the same block and/or the distance (D) between two blocks of adjacent patterns are/is dependent on the diameter of the cable.

3. The cable according to claim 1, wherein the marking is repeated at least at the two ends of the cable.

4. The cable according to claim 1, wherein the marking is repeated over the entire length of the cable.

5. The cable according to claim 1, wherein the distance (D) between two blocks of adjacent patterns is constant.

6. The cable according to claim 1, wherein the two consecutive patterns of a block of patterns are separated from each other by an unmarked region.

7. The cable according to claim 1, wherein the patterns are squares or rectangles.

8. The cable according to claim 1, wherein the core of the cable is made of aluminum.

9. A method of crimping a barrel of a contact onto the cable according to claim 1, comprising using the external marking of the sheath of the cable to check a position of the cable in the barrel.

10. The method according to claim 9, wherein the distance (D) between two adjacent patterns belonging to two different blocks of patterns is substantially equal to the depth of the barrel of the contact that has to be crimped onto said cable.

11. The method according to claim 9, comprising:

cutting the cable between two patterns of the first block;

stripping the free end of the cable for exposing a core of the said cable introducing the free end of the cable into the barrel;

verifying that the open end of the barrel of the contact is located, relative to the marking, within an acceptance interval (z) indicating a correct crimping position; and crimping the barrel of the contact onto the cable.

12. The method according to claim 11, wherein a correct crimping position is obtained when the open end of the barrel of the contact partly surrounds one of the two patterns of the block of patterns that is partly housed in the barrel.

13. The method according to claim 11, wherein the cable is stripped before it is introduced into the barrel of the contact.

14. The method according to claim 11, comprising crimping the barrel of the contact onto the core of the cable in order to produce a crimped electrical connection.

15. The method according to claim 11, comprising crimping the barrel of the contact onto the sheath of the cable in order to produce a crimped sealing connection.

16. The method according to claim 9, wherein the external marking of the sheath is produced by a laser.

17. The method according to claim 9, wherein the external marking of the sheath is carried out manually, using a marking template.

* * * * *